US008884834B1

(12) United States Patent
Paschen

(10) Patent No.: US 8,884,834 B1
(45) Date of Patent: Nov. 11, 2014

(54) ANTENNA SYSTEM WITH AN ANTENNA AND A HIGH-IMPEDANCE BACKING

(71) Applicant: FIRST RF Corporation, Boulder, CO (US)

(72) Inventor: Dean Alan Paschen, Lafayette, CO (US)

(73) Assignee: FIRST RF Corporation, Boulder, CO (US)

( * ) Notice: Subject to any disclaimer, the term of this patent is extended or adjusted under 35 U.S.C. 154(b) by 168 days.

(21) Appl. No.: 13/624,048

(22) Filed: Sep. 21, 2012

(51) Int. Cl.
*H01Q 9/44* (2006.01)

(52) U.S. Cl.
USPC ..... 343/805; 343/795

(58) Field of Classification Search
CPC ..... H01Q 1/38; H01Q 1/243; H01Q 9/0421
USPC ..... 343/700 MS, 702, 795, 805
See application file for complete search history.

(56) References Cited

U.S. PATENT DOCUMENTS

| | | | | |
|---|---|---|---|---|
| 6,512,494 | B1 | 1/2003 | Diaz et al. | |
| 6,552,696 | B1 | 4/2003 | Sievenpiper et al. | |
| 6,906,674 | B2 | 6/2005 | McKinzie, III et al. | |
| 7,071,876 | B2 | 7/2006 | Reynet et al. | |
| 7,136,029 | B2 | 11/2006 | Ramprasad et al. | |
| 7,423,608 | B2 | 9/2008 | Dunn et al. | |
| 8,077,092 | B2 | 12/2011 | Coupez et al. | |
| 2004/0044385 | A1* | 3/2004 | Fenn et al. | 607/100 |
| 2004/0201524 | A1* | 10/2004 | Yuanzhu | 343/700 MS |
| 2007/0008237 | A1* | 1/2007 | Mehta et al. | 343/895 |
| 2014/0028524 | A1* | 1/2014 | Jerauld et al. | 343/893 |

* cited by examiner

*Primary Examiner* — Tan Ho
(74) *Attorney, Agent, or Firm* — Christopher J. Kulish

(57) ABSTRACT

The present invention is directed to an antenna system that includes a broadband free-space antenna (i.e., an antenna that does not utilize a ground plane to create a resonant structure) and a high-impedance backing that allows the antenna to be positioned adjacent to a conductive surface that but for the high impedance backing would adversely affect the broadband operation of the antenna. The high-impedance backing substantially preserves the bandwidth of the antenna while also allowing the antenna to be positioned within λ/4 of the conductive surface and accommodate a predetermined amount of power.

36 Claims, 13 Drawing Sheets

ANTENNA SYSTEM WITH AN ANTENNA AND A HIGH-IMPEDANCE BACKING

FIELD OF THE INVENTION

The invention relates to antennas and, more specifically, to antennas that operate without the need for a ground plane to create a resonant structure.

BACKGROUND OF THE INVENTION

Generally, antennas can be classified based upon whether or not a ground plane is needed to create a resonant structure for operation, i.e., for transmitting and/or receiving an electromagnetic signal in a desired frequency band. Antennas that do not require a ground plane to create a resonant structure to transmit or receive an electromagnetic signal in a desired frequency band are referred to as free-space antennas. Conversely, antennas that do require a ground plane to create a resonant structure to transmit and/or receive an electromagnetic signal in a desired frequency band are referred to as ground plane resonant antennas.

Free-space antennas can be sub-classified based upon whether or not a ground plane is needed for operation. Free-space antennas that do not require a ground plane come in many forms, including but not limited to dipole, slot, spiral, and sinuous antennas to name a few. With reference to FIGS. 1A and 1B, an example of a type of dipole antenna, namely, a bowtie antenna 20 is described. The bowtie antenna 20 includes a radiative structure 22 that is comprised of a pair of co-planar radiative elements 24A, 24B. Respectively associated with the radiative elements 24A, 24B are drive points 26A, 26B. If the antenna is used to transmit an electromagnetic signal, the drive points 26A, 26B are used to apply an alternating electrical signal from a transmitter to the radiative elements 24A, 24B. The radiative elements 24A, 24B operate so as to convert the electrical signal into an electromagnetic signal that is transmitted by the radiative elements 24A, 24B. Typically, the electrical signal applied to the drive points 26A, 26B is modulated with another signal to convey data/information. If the antenna is used to receive an electromagnetic signal, the radiative elements 24A, 24B receive an electromagnetic signal and convert the electromagnetic signal into an electrical signal. The drive points 26A, 26B receive the electrical signal and convey the signal to a receiver. Typically, the electrical signal applied to the drive points 26A, 26B has been modulated with another signal to convey data/information. Transmitter/receiver 28 represents the electrical structure used to apply an electrical signal to the drive points 26A, 26B of the antenna 20 and/or receive an electrical signal from the drive points 26A, 26B of the antenna 20. The antenna 20 is operational over a bandwidth that is typically defined as the difference between the low and high frequencies at which the power output of the antenna is 3 dB of the maximum power output of the antenna. Generally, the bandwidth can be characterized as broadband or wideband when the ratio of the high to low frequencies is greater than about 2/1. In contrast, the bandwidth can be characterized as narrowband or tuned when the ratio of the high to low frequencies is less than about 2/1. The antenna 20 is considered a broadband antenna. Moreover, the antenna 20 does not have a fundamental resonance that is within its bandwidth. Relative to ground plane resonant antennas, the antenna 20 does not require a ground plane to be operational.

Among the types of free-space antennas that require a ground plane for operation are a monopole, bent monopole, and discone to name a few. With reference to FIG. 2, a planar monopole antenna 30 is described. The planar monopole antenna 30 is comprised of a radiative structure 32 and a ground plane 34 that is disposed substantially perpendicular to the radiative structure 32. Respectively associated with the radiative structure 32 and the ground plane 34 are drive points 36A, 36B. If the antenna 30 is used to transmit an electromagnetic signal, the drive points 36A, 36B are used to apply an alternating electrical signal from a transmitter to the radiative structure 32 and the ground plane 34. In response, the radiative structure 32 and ground plane 34 cooperate to produce an electromagnetic signal that radiates away from the radiative structure 32. If, in contrast, the antenna is used to receive an electromagnetic signal, the radiative structure 32 and the ground plane 34 receive the electromagnetic signal and convert the electromagnetic signal into an alternating electrical signal that is which is applied to the drive points 36A, 36B. The electrical signal is then conveyed from the drive points 36A, 36B to a receiver. Transmitter/receiver 38 represents the electrical structure used to apply an electrical signal to the drive points 36A, 36B of the antenna 30 and/or receive an electrical signal from the drive points 36A, 36B of the antenna 30. The antenna 30 is a broadband antenna and lacks a fundamental resonance that is within the bandwidth.

With reference to FIG. 3, a planar bent monopole antenna 40 is described. The planar bent monopole antenna 40 is comprised of a radiative structure 42 and a ground plane 44. The radiative structure 42 is disposed parallel to, but not co-planar with, the ground plane 44. In other embodiments of a bent monopole, the radiative structure is neither parallel to, nor coplanar with, the ground plane 44. Respectively associated with the radiative structure 42 and the ground plane 44 are drive points 46A, 46B. If the antenna 40 is used to transmit an electromagnetic signal, the drive points 46A, 46B are used to apply an alternating electrical signal from a transmitter to the radiative structure 42 and the ground plane 44 via a feed 48 (typically, a coaxial cable). In response, the radiative structure 42 and ground plane 44 cooperate to produce an electromagnetic signal that radiates away from the radiative structure 42. If, in contrast, the antenna is used to receive an electromagnetic signal, radiative structure 42 and the ground plane 44 receive the electromagnetic signal and convert the electromagnetic signal into an alternating electrical signal that is applied to the drive points 46A, 46B. The electrical signal is then conveyed from the drive points 46A, 46B to a receiver via the feed 48. Transmitter/receiver 50, which includes the feed 48, represents the electrical structure used to apply an electrical signal to the drive points 46A, 46B of the antenna 40 and/or receive an electrical signal from the drive points 46A, 46B of the antenna 40. The antenna 40 is a broadband antenna and lacks a fundamental resonance that is within the bandwidth.

Unlike free-space antennas, ground plane resonant antennas require a ground plane to create a resonant structure to transmit and/or receive an electromagnetic signal in a desired frequency band, are narrowband or tuned, and have a radiative structure with a dimension that is some portion of a wavelength in the narrowband of operation (e.g., $\lambda/2$ and $\lambda/4$). Among ground plane resonant antennas are microstrip antennas and planar inverted F-antennas (PIFA). With reference to FIG. 4, an example of a microstrip antenna 60 is described. The microstrip antenna 60 is comprised of a radiative element 62, a ground plane 64, and a dielectric 66 disposed between the radiative element 62 and the ground plane 64. For the antenna 60 to operate, the antenna 60 must resonate. Features of the antenna 60 that are critical to achieving resonance are: (1) the juxtaposition of the radiative element 62 and the ground plane 64 to form a resonant cavity and (2) the dimensions of the radiative element 62. With respect to the dimensions of the radiative element 62, the length of the radiative element must be approximately λ/2, half the wavelength of the desired operational frequency for the antenna 60. Other types of resonant antennas have similar requirements. The distance between the radiative element 62 and the ground plane 64 is less critical and typically, relatively small, i.e., much less than λ/4. Because the antenna 60 requires resonance to operate, the antenna 60 is necessarily considered to be a narrowband or tuned antenna. The "footprint" of the antenna 60 can be reduced by employing an array of pins that extend from one of the ground plane or the radiative element. Consequently, microstrip antennas can be realized that have a relatively small footprint and low profile (i.e., a small distance between the radiative element and the ground plane). However, such antennas are considered to have a narrow bandwidth or to be tuned.

In many instances, the radiative element of a free-space antenna: (1) must be positioned adjacent to a conductive surface even though positioning the antenna adjacent to the conductive surface narrows the bandwidth of the antenna or (2) is positioned adjacent to a conductive surface to modify the radiation pattern of the antenna in a desired fashion. In either case, the bandwidth of the antenna is narrowed. The term "conductive surface" is used with respect to free-space antennas to denote a conductive surface that, when a portion of a free-space antenna is positioned adjacent to the conductive surface, causes the bandwidth of the antenna to be narrowed relative to when the free-space antenna is not positioned adjacent to the conductive surface. Hence, in the case of many types of monopole and bent monopole antennas, a small portion of the monolithic structure that is typically referred to as the ground plane and that is positioned immediately adjacent to the radiative element is considered to be a conductive surface. For example, with reference to FIG. 3, a portion 68 of the ground plane 44 that underlies the radiative element 42 would be considered a conductive surface. The term "ground plane" as used hereinafter in discussing free-space antennas denotes the structure that is necessary for the antenna to achieve the desired broadband operation and does not substantially adversely affect the bandwidth of the antenna. Consequently, the structure in a monopole and bent monopole that is typically referred to as a "ground plane" is herein considered to be comprised of a ground plane and a conductive surface, even though the ground plane and conductive surface are typically part of a monolithic structure that is typically referred to as a "ground plane". Further, the ground plane as used with respect to free-space antennas should also be distinguished from the ground plane used in ground plane resonant antennas. The ground plane in a free-space antenna does not cooperate with another element of the antenna to create a resonant structure within the desired bandwidth of operation. In contrast, the ground plane in a ground plane resonant antenna does cooperate with one or more other elements in the antenna to create a resonant structure within the desired bandwidth of operation.

Presently, when a radiative element of many types of free-space antennas is positioned adjacent to a conductive surface, the distance between the radiative element and the conductive surface is established at substantially λ/4 to avoid destructive interference between the signal produced by the radiative element and the signal reflected from the conductive surface. In this case, the wavelength λ is a wavelength that is within the original bandwidth of the antenna. Given that the antenna is now largely restricted to operation at or about this wavelength, it should be appreciated that the bandwidth of the antenna has been narrowed. As such, positioning a broadband, free-space antenna adjacent to a conductive surface transforms the antenna from a broadband antenna into a narrowband or tuned antenna and substantially limits the distance between the radiative element and the conductive surface to λ/4, which can be a substantial distance when the wavelength is a relatively large or the frequency is relatively low. FIG. 5 illustrates a bowtie antenna 70 positioned adjacent to, and λ/4 from, a conductive surface 72.

Currently, two approaches are known for reducing the distance between the radiative element(s) of a free-space antenna and a conductive surface. In the first approach, a high-impedance backing is disposed between the radiative element(s) and the conductive surface. The high-impedance backing includes an array of cells with each cell comprised of a conductive patch and a wire-like conductor that is connected to the patch. The conductive patch is substantially parallel to the radiative and conductive surfaces and the wire-like conductor is substantially normal to the radiative and conductive surfaces. An example of an antenna and such a high-impedance backing can be found in U.S. Pat. No. 6,552,696. FIG. 6 illustrates a bowtie antenna 80 and a high-impedance backing 82 that is interposed between the antenna and a conductive surface 84. The bowtie antenna 80 includes a pair of radiative elements 86A, 86B. The high-impedance backing 82 is comprised of an array of cells 88, each of which is comprised of a patch 90 and a wire-like conductor 92 extending between the patch 90 and the conductive surface 86. The high-impedance backing 82 also includes a dielectric disposed between the patches and the radiative elements 86A, 86B. The use of the high-impedance backing 82 allows the distance between the radiative elements 86A, 86B and the conductive surface 86 to be reduced to less than λ/4.

In the second approach, a dielectric is established between the radiative element(s) and the conductive surface. FIG. 7 illustrates a bowtie antenna 100 comprised of a pair of radiative elements 102A, 102B and a dielectric 104 that is interposed between the antenna and a conductive surface 106. The dielectric allows the distance between the radiative elements 102A, 102B and the conductive surface 106 surface to be reduced such that the distance is less than λ/4.

While both of these approaches allow the distance between the radiative elements and the respective conductive surfaces to be reduced, these approaches also turn what was a broadband antenna before being positioned adjacent to a conductive surface into a narrowband or tuned antenna rather than a broadband or wideband antenna.

Another consideration with respect to an antenna is the amount of power that must be accommodated. Generally, antennas that are only used to receive electromagnetic signals typically have relatively low power requirements. In contrast, many antennas that are used to transmit electromagnetic signals have relatively high power requirements. For example, many radar systems have high power requirements due to the long distances over which the electromagnetic signal must be effectively radiated.

SUMMARY OF THE INVENTION

The present invention provides an antenna system comprised of a broadband free-space antenna and a high-impedance backing that allows the antenna to be positioned adjacent to a conductive surface that that would otherwise have a substantial adverse effect on the bandwidth of the of the antenna. Moreover, the high-impedance backing allows the antenna to be positioned less than $\lambda_{low}/4$ from the conductive surface, where $\lambda_{low}$ is the wavelength associated with the frequency that defines the low frequency end of the bandwidth. Further, the high-impedance backing is capable of accommodating a predetermined amount of power.

In one embodiment, the antenna system is comprised of a broadband free-space antenna that includes a radiative structure with a surface and a high-impedance backing positioned adjacent to the surface of the radiator structure. The high-impedance backing is comprised of an array of conductive pins, a first dielectric located between the surface of the radiative structure and the array of conductive pins, and a second dielectric located between the pins. Further, pins in the array of pins each have a shape and a position and are each made of a material such that the pin: (a) presents a high reactive impedance and low ohmic loss to the antenna, (b) is substantially insusceptible to the E-field produced when the antenna is operating inducing a current within the pin, (c) is substantially non-resonant, and (d) is capable of accommodating a predetermined amount of power.

In another embodiment, the shape and position of a pin in the array of conductive pins for a particular pin material is constrained to being within a boundary. If the shape and position of the pin is within the boundary, the pin will present a high reactive impedance with low ohmic loss, be substantially insusceptible to currents induced by the E-field produced when the antenna is operating, be substantially non-resonant, and be capable of accommodating the desired amount of power. To elaborate, each pin in the array extends from a first terminal end to a second terminal end with the first terminal end being closer to the surface of the radiative structure than the second end. Further, the first terminal end of a pin is associated with a particular point on the surface of the radiative structure. By way of example, the required characteristics of the pin (high reactive impedance etc.) can be readily satisfied, when the surface of the radiative structure and conductive surface are substantially parallel to one another, by a pin that is suitably long, straight, cylindrical, and monolithic that is positioned substantially normal to the surface associated with the point on the surface of the radiative structure for a given pin material. However, many other shapes for a pin and/or orientations of a pin relative to the point on the surface of the radiative structure adequately satisfy the noted criteria. For instance and continuing with the same example, the noted long, straight, cylindrical, and monolithic pin can be positioned so as to be "non-normal" to the surface associated with the point on the surface of the radiative structure and still have the noted characteristics. As to shape, and continuing with the example, the pin can be long, sinuous, cylindrical and monolithic (steel wool-like) and still provide the noted characteristics. Further, the more a pin deviates from being normal to the surface associated with the point on the surface of the radiative structure, the greater the cross-sectional area of the pin in a plane normal to the E-field must be to accommodate a given power requirement for a given pin material. As an alternative to increasing the cross-sectional area of the pin when the pin deviates from being normal, a pin made of a different material that has greater conductivity can be employed to accommodate a given power requirement. Changing the material of the pin, in essence, defines a different boundary that the shape and position of the pin must accommodate. The foregoing indicates that the shape of a pin, position or orientation of the pin, and material from which the pin is made each contribute to defining the boundary within which a pin must lie to present a high reactive impedance with low ohmic loss, be substantially insusceptible to currents induced by the E-field, be substantially non-resonant, and accommodate a predetermined power. As such, it should be appreciated that pins with designs that increasingly deviate from a particular boundary will increasingly fail to provide the noted characteristics.

In one aspect, the boundary is at least partially defined by a two-dimensional or cross-sectional boundary that lies is in a plane that is normal to the surface associated with the point on the surface of the radiative structure and contains the E-field vector representative of the direction and magnitude of the electric field produced when the antenna is operating. Further, the boundary is in the form of quadrilateral that lies in the plane. The quadrilateral is comprised of a top side that is immediately adjacent to the surface, a bottom side that is farther from the surface than the top side, and a pair of lateral sides that diverge from one another with increasing distance from the surface. Due to the diverging lateral sides, the top side is shorter than the bottom side. In the case when the surface of the radiative structure and the conductive are each planar and parallel to one another, the boundary has a trapezoidal shape with the top and bottom sides being parallel to one another and the lateral sides having the same angle relative to the top side and substantially the same lengths. In the case when the surface of the radiative structure and the conductive surface are each planar but not parallel to one another, the trapezoid becomes skewed or warped such that the top and bottom sides are no longer parallel to one another and/or the angles between the lateral sides and the top side are not equal to one another and/or the lateral sides are of different lengths. In the case when at least one of the surface of the radiative structure and the conductive surface is non-planar, the quadrilateral has at least one and typically two or more curved sides.

In another aspect, the boundary is a three-dimensional or volumetric boundary. A pin within the three-dimensional boundary presents a high reactive impedance with low ohmic loss, is substantially insusceptible to currents induced by the E-field, is substantially non-resonant, and accommodates a predetermined power. One way to construct or conceptualize the three-dimensional boundary is to connect the two dimensional or cross section boundaries associated with several points on the surface of the radiative structure that each have substantially similar E-field magnitude profiles, i.e., the magnitude of the E-field drops off with increasing distance from the radiative structure in the substantially similar manner or pattern at each point. A different way to construct or conceptualize the three dimensional boundary is to translate the two-dimensional or cross-sectional boundary between points associated with the radiative structure that have the substantially similar E-field magnitude profile to sweep out or define the three-dimensional volume or boundary for the pin. For example, if substantially the same trapezoidal cross section boundary is associated with each of the points and the points are in a straight line, the three-dimensional boundary is a straight "mesa-like" volume with a trapezoidal cross-section. Depending on the orientations of the points on the surface of the radiative structure, the mesa can be straight, curved, or have a combination of straight and curved sections.

In another embodiment, the antenna system is comprised of a broadband, free-space antenna and a high-impedance backing that is comprised of an array of conductive pins tailored to the electric field profile of the antenna over the frequencies in the bandwidth. The tailoring of the array of conductive pins yields more consistent operation of the high-impedance backing over the bandwidth of the antenna. To elaborate, a broadband free-space antenna has an electric field profile for each frequency in the bandwidth. For example, in a bowtie antenna, the electric field profile for the high frequency that defines the upper end of the bandwidth is concentrated towards the center of the radiative structure of the antenna (i.e., near the drive points) and diminishes elsewhere across the radiative structure. In contrast, the electric field profile for the low frequency that defines the low end of the bandwidth is concentrated toward the outer edges of the radiative structure of the antenna (i.e., far from the drive points) and diminishes elsewhere. The electric field profile for an intermediate frequency is concentrated at locations of the radiative structure that lie in between the locations associated with the high and low frequencies and diminish elsewhere. The high-impedance backing is tailored to such an electric field profile by scaling at least one geometric characteristic of the pins in the array. Among the possible geometric characteristics that can be scaled are length of the pins, lateral cross-section of the pins, the spacing between pins, the distance between the pins and the radiative surface of the antenna, and combinations of these characteristics. Each of these characteristic increases as the frequency of interest in the bandwidth decreases. For example, in a bowtie antenna with an array of pins that underlies the entire radiative structure, the pins located near the center of the radiative structure are shorter than the pins located near the outer edges of the radiative structure.

DETAILED DESCRIPTION

Figure 1A:
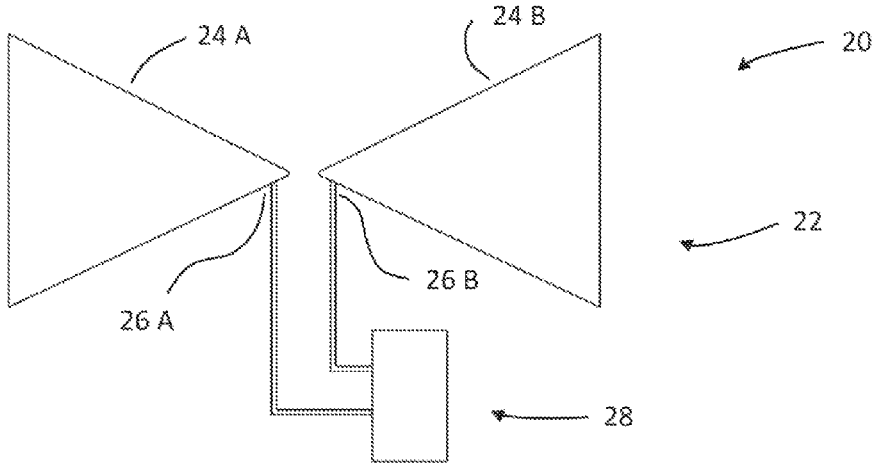
FIGS. 1A and 1B respectively illustrate a plan view and perspective view of an exemplary embodiment of a bowtie antenna, a type of free-space antenna, in a transmission/reception system.
Figure 1B:
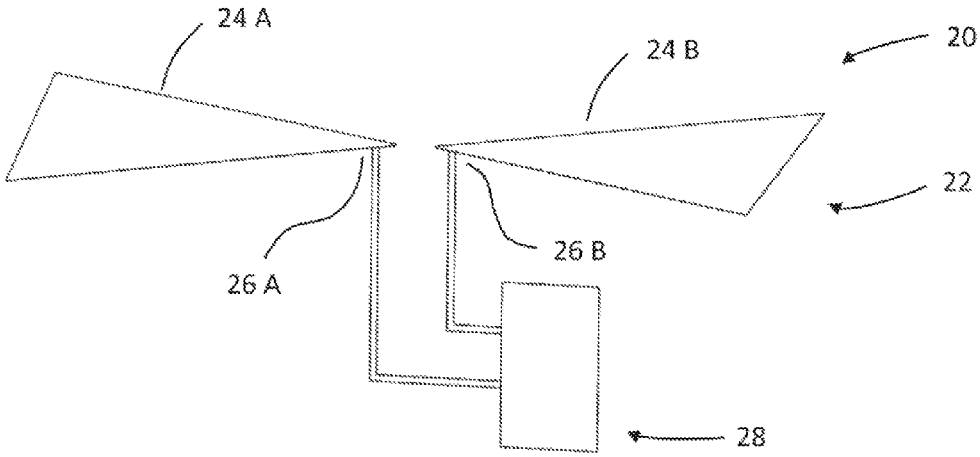
Figure 2:
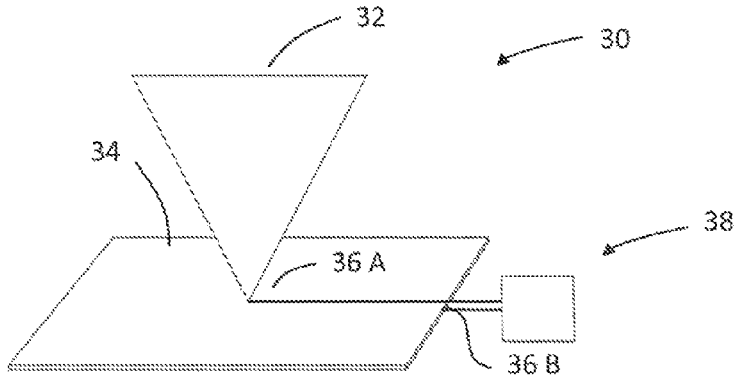
FIG. 2 illustrates an exemplary embodiment of a monopole antenna, a type of free-space antenna, in a transmission/reception system.
Figure 3:
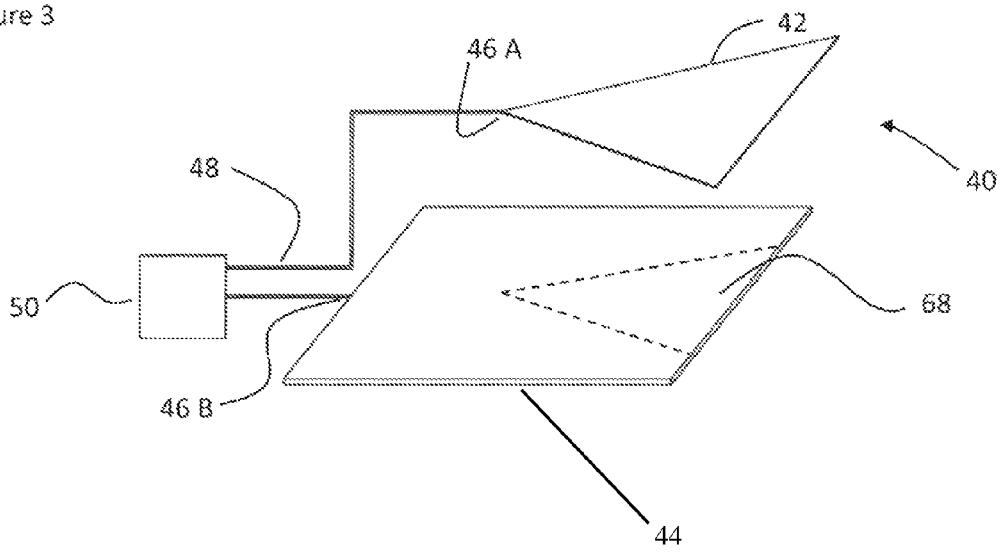
FIG. 3 illustrates an exemplary embodiment of a bent monopole antenna, a type of free-space antenna, in a transmission/reception system.
Figure 4:
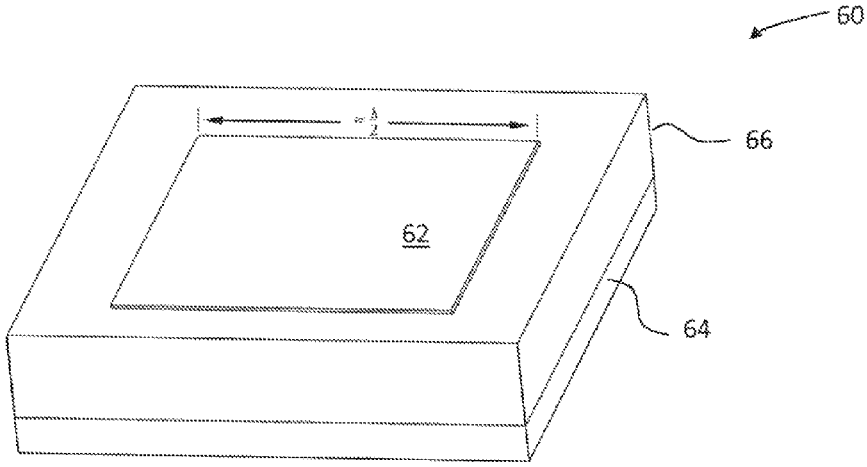
FIG. 4 illustrates an embodiment of a microstrip antenna, a type of ground plane resonant antenna.
Figure 5:
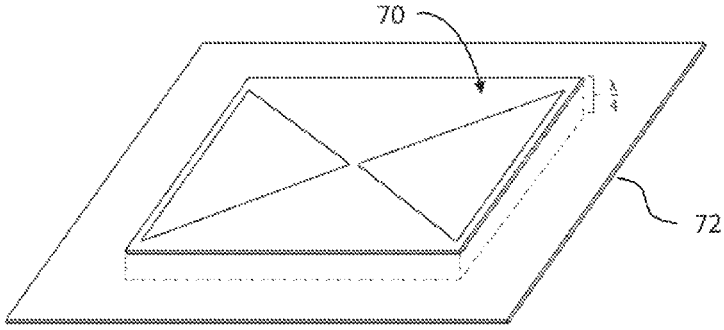
FIG. 5 illustrates an embodiment of a bowtie antenna that is positioned a quarter wavelength ($\lambda/4$) from a conductive surface.
Figure 6:
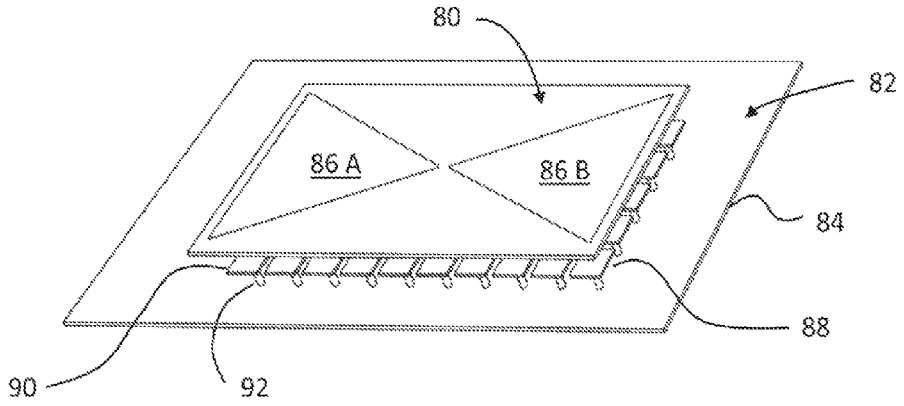
FIG. 6 illustrates an embodiment of a bowtie antenna and a high-impedance backing comprised of an array of patches and conductors interposed between the antenna and a conductive surface.
Figure 7:
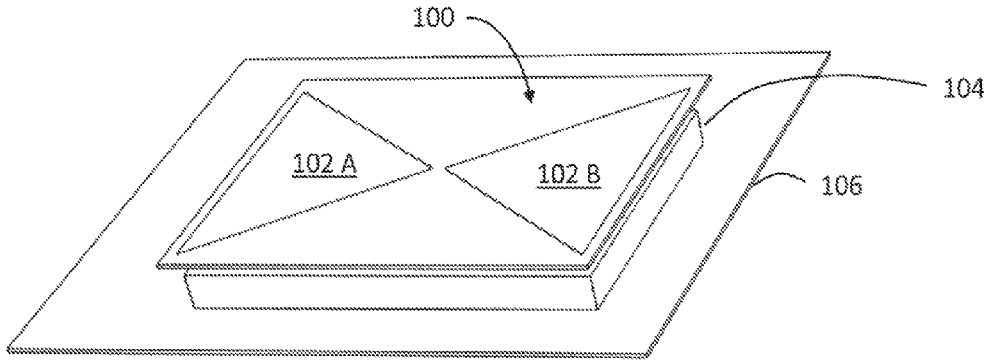
FIG. 7 illustrates an embodiment of a bowtie antenna and a high-impedance backing comprised of a dielectric interposed between the antenna and a conductive surface.
Figure 8:
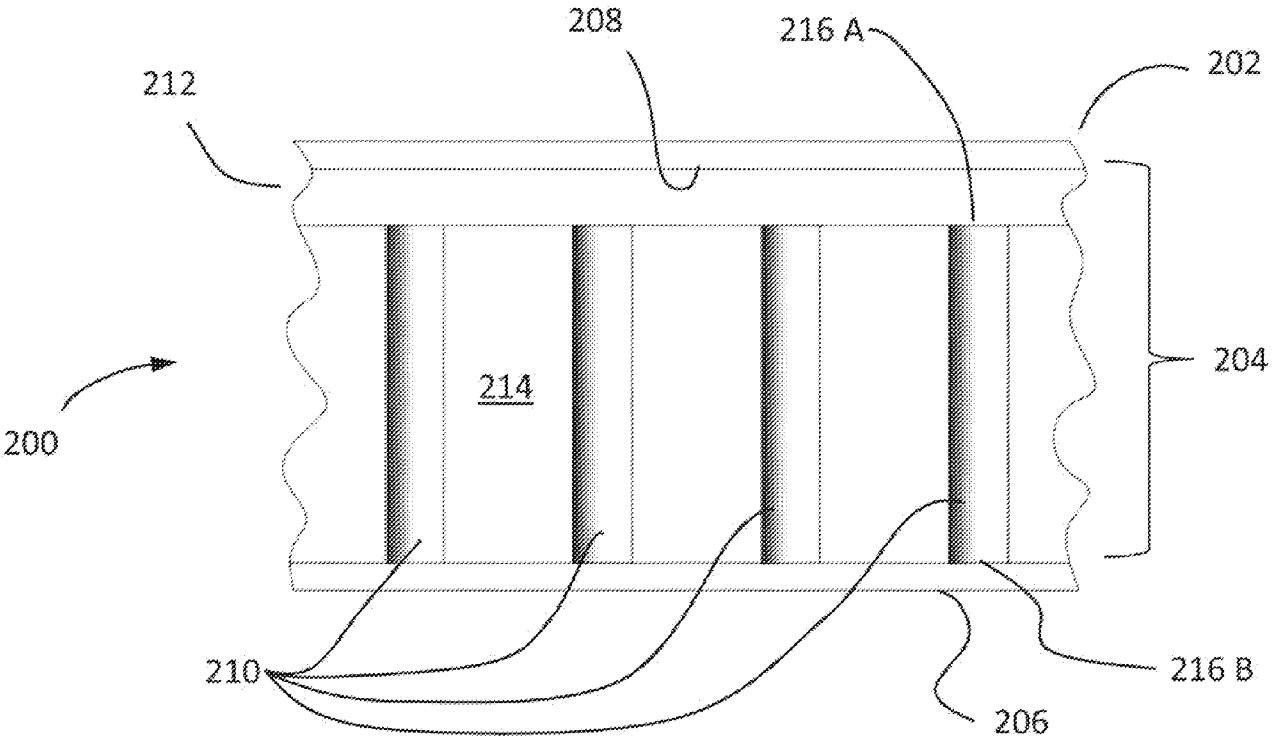
FIG. 8 is a schematic side view of a portion of an antenna system comprised of a broadband, free-space antenna and a high-impedance backing that is positioned adjacent to a conductive surface.

With reference to FIG. 8, a schematic side view of a portion of an antenna system 200 that allows a broadband, free-space antenna to be positioned adjacent to a conductive surface while substantially preserving the broadband operation of the antenna and allowing the antenna to be positioned within $\lambda_{low}/4$ of the conductive surface, where $\lambda_{low}$ is the wavelength associated with the frequency that defines the low-end of the bandwidth of the antenna, and that is capable of accommodating a predetermined amount of power, is described.

Generally, the antenna system 200 is comprised of a broadband, free-space antenna that includes a radiative structure 202 and a high-impedance backing 204. A conductive surface 206 of the type that could adversely affect the operation of the antenna is also shown in FIG. 8. However, the conductive surface 206 is not normally considered part of the antenna system 200. In a substantial number of instances, the conductive surface 206 is dictated by the application environment in which the antenna is meant to operate. For example, the conductive surface 206 may be a conductive surface associated with an aircraft or ship.

The broadband, free-space antenna may be of the type that requires a ground plane to be operative (e.g., a planar bent monopole) or be of a type that does not require a ground plane to be operative (e.g., a bowtie). Regardless of whether or not a particular broadband, free-space antenna requires a ground plane to be operative, the antenna has a radiative structure whose broadband operation is adversely affected by being positioned adjacent to a conductive surface. Consequently, any ground plane required for the broadband, free-space antenna to be operative is omitted from FIG. 8. The radiative structure 202 can be a single element (e.g., the radiative element of a planar bent monopole) or multiple elements (e.g., a bowtie). The radiative structure 202 can be planar, curved, or a combination of planar and curved. Further, the radiative structure 202 has a surface 208 that is positioned adjacent to the high-impedance backing 204.

The high-impedance backing 204 is located between: (a) the portion of the radiative structure that is located adjacent to the conductive surface 206 and whose operation would be adversely affected by being positioned adjacent to the conductive surface 206 and (b) the conductive surface 206. The high-impedance backing 204 is comprised of an array of conductive pins 210, a first dielectric 212 positioned between the array of conductive pins 210 and the radiative structure 202, and a second dielectric 214 that extends between the pins in the array of conductive pins 210. Ideally, each of the pins in the array of conductive pins 210 presents: (a) a high reactive impedance and low ohmic loss relative to the radiative structure 202, (b) is substantially insusceptible to a current being induced by the E-field produced when the antenna is operational, (c) is substantially non-resonant, and (d) is capable of accommodating a predetermined amount of power. Each pin respectively has first and second terminal ends 216A, 216B. The first terminal end 216A, due to the depth of the first dielectric, is a first normal distance from the surface 208. The second terminal end 216B is located at a second normal distance from the surface 208 that is greater than the first distance. The difference between the first and second distances or the normal length of the pin contributes the pin appearing as a high reactive impedance relative to the radiative structure 202. As such, there is a desired normal length for a pin, i.e., the normal length of pin that is needed to so that the pin makes a sufficient contribution to the pin appearing as a high reactive impedance to the radiative structure. To elaborate, if the normal length of a particular pin is less than the desired normal length, the effectiveness of the pin is less. If the normal length of a pin is more than the desired normal length, the pin is effective. However, the portion of the pin that exceeds desired normal length contributes little, if anything, to the effectiveness of the pin.

The array of conductive pins 210 is comprised of a at least two conductive pins but more typically the array is comprised of tens, hundreds, or thousands of conductive pins depending, at least in part, on the size of the conductive surface 206 adjacent to which the radiative structure 202 is to be positioned.

The first dielectric 212 can take many forms. For instance, the first dielectric 212 can be a solid, gas, or liquid dielectric or a combination of two or more such dielectrics. Typically, the first dielectric 212 is a gas or a solid. Suitable gaseous dielectrics include air and dry nitrogen. Suitable solid materials include several different types of glass, several different ceramic materials, several different types of plastics, and other materials known to those skilled in the art The second dielectric 214 can also take many forms and be a solid, gas, or liquid dielectric or a combination of two or more such dielectrics. Suitable gaseous dielectrics include air and dry nitrogen. Suitable solid materials include several different types of glass, several different ceramic materials, several different types of plastics, and other materials known to those skilled in the art. In certain embodiments, the second dielectric 214 can also serve as the structure that supports the some or all of the pins in the array of conductive pins 210. For example, all or a portion of the second dielectric 214 can be a wood block that supports some or all of the pins in the array of conductive pins 210. The second dielectric 214 need only extend from the bottom of the first dielectric 212 to a depth at which the pins are of a sufficient length to provide substantial non-resonance, insusceptibility to E-field induced current, and high reactive impedance with low ohmic loss.

It should be appreciated that the structural characteristics of some or all of the pins in the array of conductive pins 210, the first dielectric 212, and/or the second dielectric 214 may not be capable of maintaining the required positional relationships between the surface 208 of the radiative structure 202 and the conductive surface 206. In such cases, a frame (not shown) is required to maintain the required positional relationships. For example, if the pins in the array of conductive pins 210 are highly flexible, the first dielectric 212 is air, and the second dielectric 214 is air, a frame is needed to maintain the needed positional relationships of the radiative structure 202 and the high-impedance backing 204. In the case in which one or both of the first dielectric 212 and second dielectric 214 is a gas or liquid, all or a portion of a frame may also need to serve as container for the gas or liquid. Other combinations of characteristics of the array of conductive pins 210, the first dielectric 212, and/or the second dielectric 214 and the particular application in which the antenna system 200 is meant to operate may require a frame to maintain the desired positional relationships between the surface 208 of the radiative structure 202 and the conductive surface 206.

Each pin in the array of conductive pins 210 is made of a conductive material. Suitable conductive materials include: (a) metallic non-magnetic conductive materials, (b) metallic magnetic conductive materials, and (c) non-metallic conductive materials. Examples of metallic non-magnetic conductive materials include copper and aluminum. Examples of metallic magnetic conductive materials include iron, steel, nickel, cobalt, and alloys thereof. Examples of non-metallic conductive materials include carbon fiber and conductive organics. The power requirement under which the high impedance backing 204 must operate may limit the material that can be employed for the pin to a particular conductive material or group of conductive materials. The structural requirements (shock, load etc.) under which the antenna high impedance backing 204 must operate may also limit the material that can be used for a pin to a specific conductive material or group of conductive materials.

Figure 9:
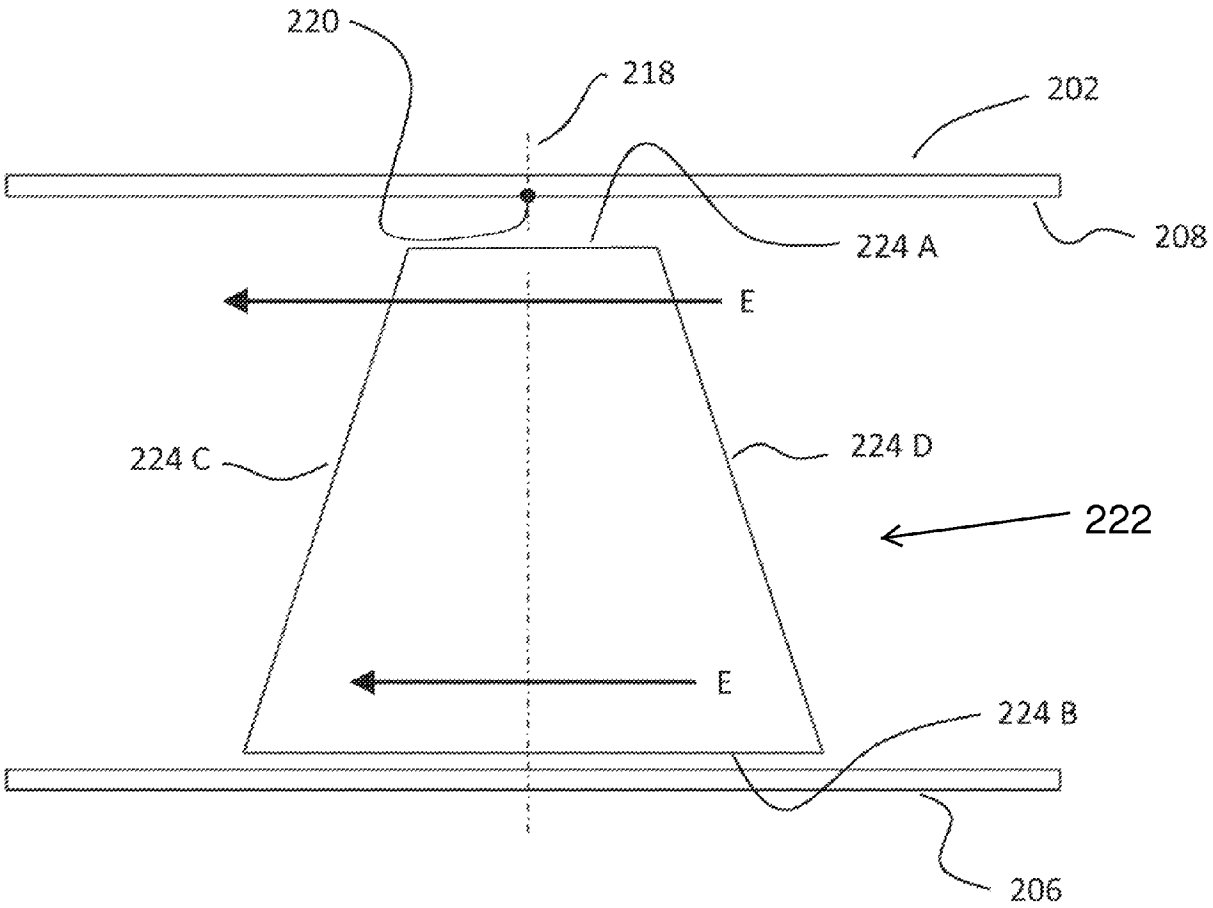
FIG. 9 illustrates a two-dimensional or cross-sectional boundary that at least partially defines the extent over which a pin in an array of pins can extend and be effective.
Figure 10A:
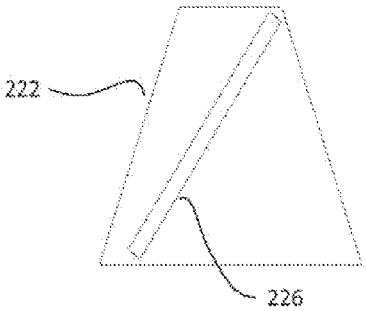
FIGS. 10A-10D respectively illustrate a cylindrical pin, a sinuous pin, a bristle comprised of multiple sub-pins, and a steel wool-like pin each located within the two-dimensional boundary shown in FIG. 9.
Figure 10B:
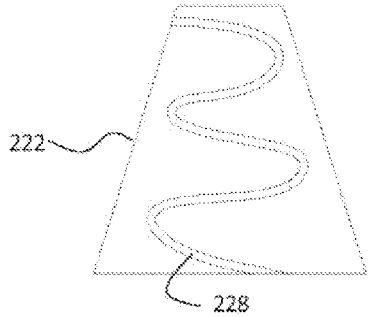
Figure 10C:
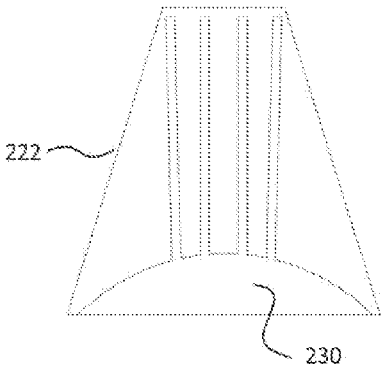
Figure 10D:
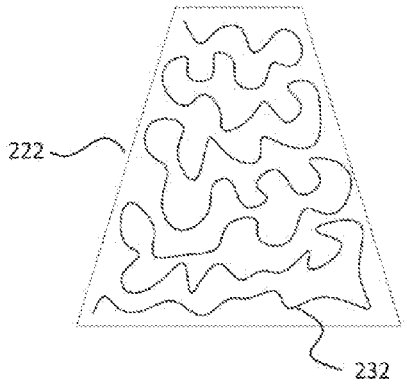

Each pin in the array of pins can have a number of shapes and positions for a particular pin material and provide substantial non-resonance, insusceptibility to E-field induced currents, high reactive impedance with low ohmic loss, and a desired power capability. With reference to FIG. 9, the shapes and positions of a planar pin (i.e., a pin that substantially lies in an E-field plane) that provides these features falls within a cross-section boundary that lies in a plane that contains the electric field or E-field vector. To elaborate, when an antenna is in operation, an E-field is produced between the surface 208 of the radiative structure 202 and the conductive surface 206. The E-field at any point between the surface 208 and the conductive surface 206 can be represented by an E-field vector that represents both the direction of the E-field and the magnitude of the E-field. When the surface 208 and the conductive surface 206 are both planar and parallel to one another, as in FIG. 9, the E-field vector at any point along a line 218 that is normal to the surface 208 at point 220 lies in a plane that is substantially perpendicular to the surface 208 and conductive surface 206. The magnitude of the E-field vector is greater (i.e., the vector is longer) closer to the surface 208 and diminishes with increasing distance from the surface 208 (i.e., the vector becomes shorter). A boundary 222 lies within this E-field plane and defines the cross-sectional extent within which the pin of a particular material needs to fall to provide the noted benefits. In FIG. 9, the boundary is a quadrilateral 222 with a trapezoidal shape. The quadrilateral 222 has a top side 224A located adjacent to the surface 208, a bottom side 224B that is substantially parallel to the top side 224A and longer than the top side 224A, a first lateral side 224C that extends between the top side 224A and the bottom side 224B, and a second lateral side 224D that extends between the top side 224A and bottom side 224B. The distance between the top side 224A and the bottom side 224B is the desired normal length for a pin, i.e., the normal length of pin that is needed to so that the pin makes a sufficient contribution to the pin appearing as a high reactive impedance to the radiative structure 202. In many cases, the desired distance plus the depth of the first dielectric 212 and any distance between the bottom side 224B and the conductive surface 206 will be less than $\lambda_{low}/4$. Consequently, the distance between the top side 224A and the bottom side 224B will be less than $\lambda_{low}/4$. A pin that only extends a portion of the distance between the top side 224A and the bottom side 224B will be less effective. A pin can otherwise, however, have any cross-sectional shape or orientation within the quadrilateral 222 and be effective. A pin that extends beyond the top side 224A (i.e., is closer to the surface 208), beyond first lateral side 224C, and/or beyond the second lateral side 224D will not provide substantial non-resonance, insusceptibility to E-field induced currents, high reactive impedance with low ohmic loss. With reference to FIGS. 10A-10D, a pin can have any number of shapes and orientations within the quadrilateral 222 including a tilted pin 226, a sinuous pin 228, a bristle or brush-like pin 230 made up of several sub-pins, and a steel wool-like pin 232.

The shape of the quadrilateral 222 is affected by the material used for a pin. For instance and continuing with the example of substantially planar radiative structure that is disposed substantially parallel to a conductive surface, one material may have a relatively narrow (closer lateral sides) and longer (greater distance between top and bottom sides) quadrilateral than another material. The material used for the pins can involve both power and structural requirements for the antenna system.

Figure 11:
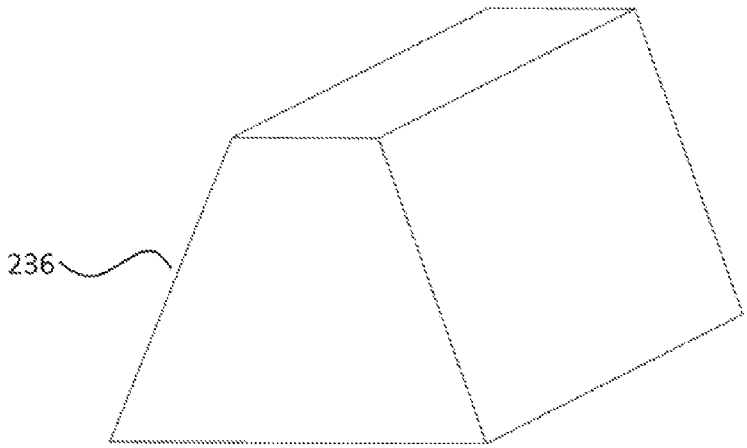
FIG. 11 illustrates a three-dimensional boundary in the form of a a straight "mesa-like" volume that defines the volumetric extent over which a pin in an array of pins can extend and be effective.
Figure 12:
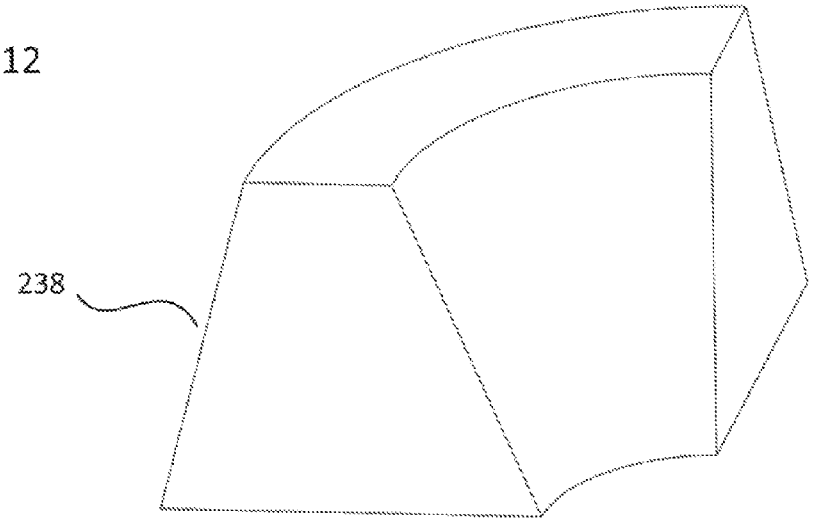
FIG. 12 illustrates a three-dimensional boundary in the form of a curved "mesa-like" volume that defines the volumetric extent over which a pin in an array of pins can extend and be effective.

While the quadrilateral 222 defines a boundary beyond which a pin becomes increasingly ineffective, the quadrilateral 222 is limited to a plane. A pin can, however, be within a three-dimensional volume and provide substantial non-resonance, insusceptibility to E-field induced currents, high reactive impedance with low ohmic loss, and address a desired power requirement. To elaborate and with reference to FIG. 9, there are points on the surface 208 that are adjacent to point 220 that each have an E-field along a line normal to the relevant point that exhibits a substantially similar profile to the E-field profile along the line 218, i.e., the line that passes through point 220, and lie in a different plane than the plane associated with point 220. The E-field profile refers to the change in the E-field magnitude along the relevant normal line. As such, associated with each of these points on the surface 208 is a quadrilateral boundary that is substantially similar to the quadrilateral 222. Connecting these quadrilateral boundaries to one another defines a three dimensional boundary volume for a pin. Alternatively, the three dimensional boundary can be constructed by translating the quadrilateral 222 between these points to define the three dimensional boundary volume. With reference to FIG. 11, when the points on the surface with similar E-field profiles extend along a straight line, a three-dimensional boundary in the form of a flat-topped triangular prism or a linear mesa 236 is defined. With reference to FIG. 12, when the points on the surface extend along a curved line, a three dimensional boundary in the form or curved mesa 238 is defined. Within such three dimensional boundaries, the potential shapes and orientations of a pin increase relative to the potential shapes and orientations that can be accommodated by quadrilateral 222. For instance, the tilted pin 226 can tilt in two planar directions, the sinuous pin 228 can become a helical coil, the bristles 230 can be distributed over a two-dimensional area to form a three dimensional cluster, and the steel wool-like pin 232 can expand to file the volume defined by the three dimensional volume. If a three-dimensional volume, such as mesas 236 and 238 are of sufficient length, the volume can accommodate a mesa-like pin structure, a fin-like pin (i.e., narrow mesa), and comb-like pin. While a number of pin shapes and positions are feasible, it should be appreciated that the most cost effective pins are likely to be pins having a substantially uniform cross-section, such as cylindrical pins and square pins, or pins comprised of sub-pins with cylindrical, square, or triangular cross-sections (as in wire brushes).

Figure 13:
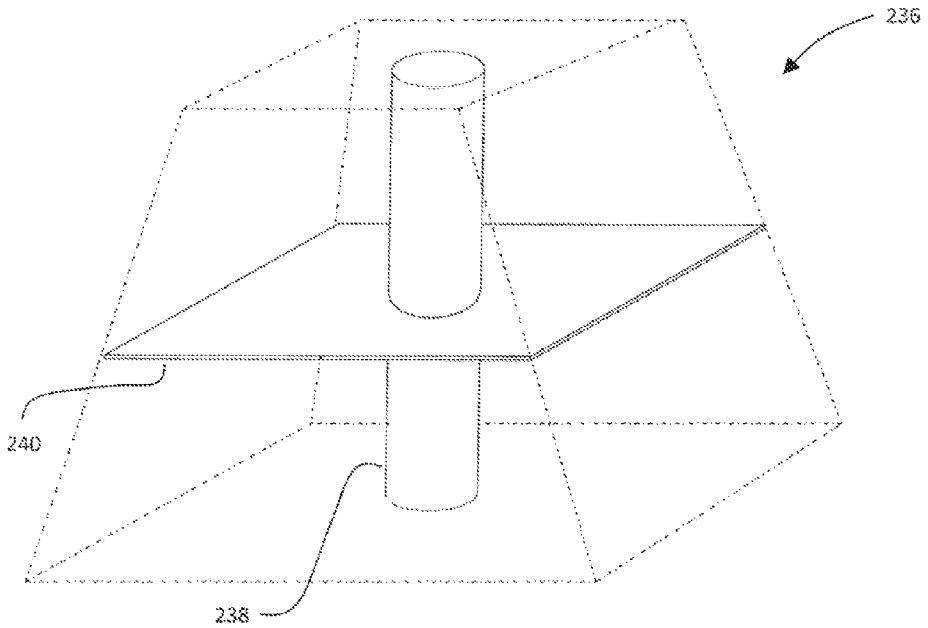
FIG. 13 illustrates a particular pin structure that lies within the three-dimensional boundary illustrated in FIG. 11.

It should be appreciated that pin structures that superficially appear to be similar to the pin and patch structures associated with known high-impedance backings are feasible. For instance and with reference to FIG. 13, a pin 236 comprised of a rod 238 and a patch 240 mounted on the rod that fits within a mesa boundary is feasible. While the pin 236 appears to be similar to the rod and patch structures shown in U.S. Pat. No. 6,552,696, the shape and position of the pin 236 within the three dimensional boundary 236 for a given pin material substantially assures that the pin provides substantial non-resonance, substantial insusceptibility to E-field induced currents, a high reactive impedance with low ohmic loss, and the ability to accommodate a desired power requirement. In contrast, the rod and patch structures shown in the noted patent would not fit within the relevant three-dimensional boundary and possess the noted characteristics of substantial non-resonance etc.

Figure 14:
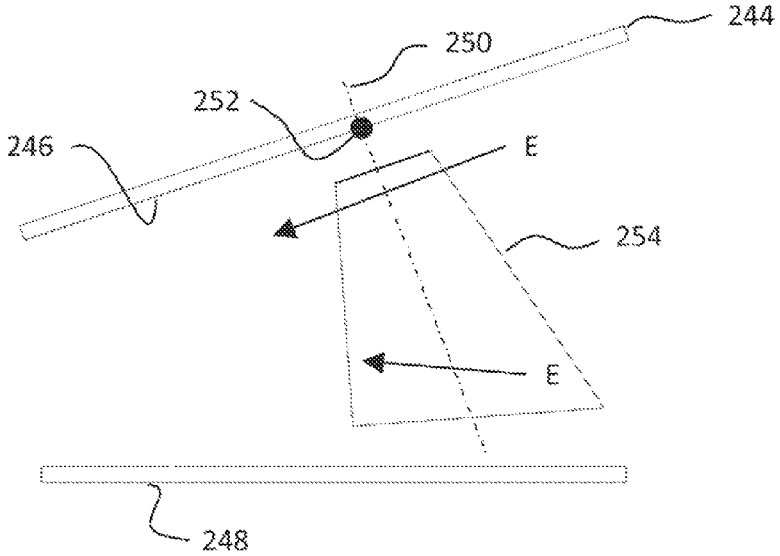
FIG. 14 illustrates a two-dimensional or cross-sectional boundary for a pin in the array of pins when the surface of the radiative structure of the antenna and a conductive surface are each planar but not parallel to one another.

While the cross section boundary for pins of a given material is a trapezoidal-shape when the surface 208 and the conductive surface 206 are substantially planar and parallel to one another, the cross section boundary shape changes when the surface of the radiative structure and the conductive surface 206 are planar but not substantially parallel to one another. With reference to FIG. 14, a planar radiative structure 244 with a surface 246 is disposed so as to not be parallel to a conductive surface 248. In this case, the E-field vector at any point along a line 250 that is normal to the surface 246 at point 252 lies in a plane that is substantially perpendicular to the surface 246 and conductive surface 248. However, the direction and magnitude of the E-field changes from point to point along the line 250 due to the surface 246 and the conductive surface 248 being non-parallel. This, in turn, produces a boundary 254 that is skewed relative to the boundary 222. This boundary 254 can be translated to produce three-dimensional boundaries in substantially the same manner as discussed with respect to FIGS. 11 and 12.

Figure 15:
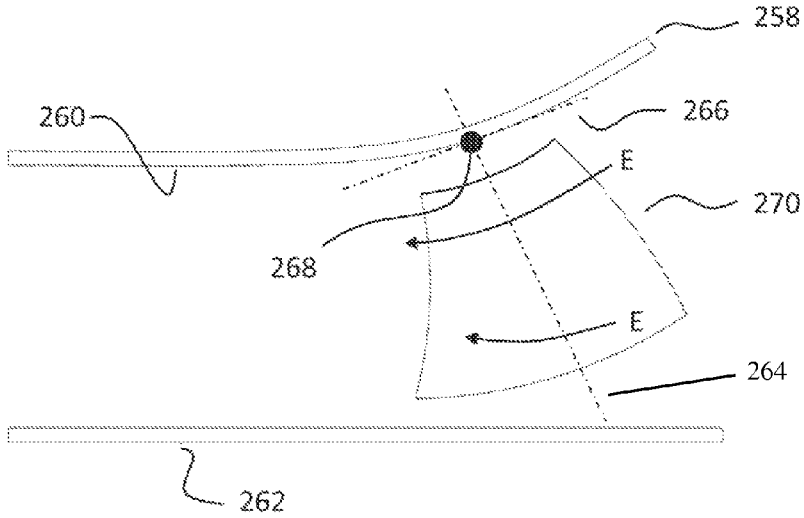
FIG. 15 illustrates a two-dimensional or cross-sectional boundary for a pin in the array of pins when the surface of the radiative structure of the antenna follows a simple curve and the surface is positioned adjacent to a planar conductive surface

When one or both of a radiative structure and a conductive surface are curved, the cross section boundary changes relative the cross section boundary 222. To illustrate and with reference to FIG. 15, when a radiator structure 258 with a surface 260 that has a simple curve is disposed adjacent to a planar conductive surface 262, a two-dimensional boundary with curved sides is defined. In this case, the E-field vector at any point along a line 264 that is normal to a surface vector 266 at point 268 lies in a plane that is substantially perpendicular to the surface 260 and the conductive surface 262. However, the direction and magnitude of the E-field changes from point to point along the line 264 due to the surface 260 and the conductive surface 262 being non-parallel. This, in turn, produces a two-dimensional boundary 270 that is skewed relative to the boundary 222. In this case, the quadrilateral boundary 254 has one or more curved sides. This boundary 270 can be translated to produce three-dimensional boundaries in substantially the same manner as discussed with respect to FIGS. 11 and 12.

As can be appreciated, depending upon the type of free-space antenna being employed, the surface associated with a radiative structure can have many different shapes, including complex curves like in a horn or cone antenna. Likewise, the conductive surface can also have many different shapes, the shape typically being dictated by a particular application for the antenna system. As such, the shapes of the two-dimensional boundaries are determined based on the geometry of the surface associated with the radiative structure and the geometry associated with the conductive surface. Nonetheless, the two-dimensional boundaries with respect to most, if not all, of the typical combinations of these geometries are believed to have a quadrilateral shape. However, as the surface associated with the radiative structure and/or the shape of the conductive surface deviate further from planar geometry, the three-dimensional boundary typically becomes more difficult to define. Nonetheless, computational analysis can be employed to define a three-dimensional boundary for a pin of a particular material such that a pin that falls within the boundary will exhibit substantial non-resonance, substantial insusceptibility to currents induced by the E-field of the antenna, a high reactive impedance with low ohmic loss, and the ability to accommodate a predetermined power.

While each pin in the array of pins 210 exhibits substantial non-resonance, substantial insusceptibility to E-field induced currents, high reactive impedance with low ohmic loss, and the ability to accommodate a predetermined amount of power, the relationship of the pins in the array of pins 210 to one another must also satisfy certain of these requirements. To elaborate, a first pin must be must be sufficiently spaced from an immediately adjacent second pin (i.e., two pins with no other pin located between the two pins) such that the pair of pins is substantially non-resonant, substantially insusceptible to currents being induced by the E-field, and present a high reactive impedance with low ohmic loss. Generally, the second dielectric 214 is located between immediately adjacent pins. However, conductive material can extend between or connect the immediately adjacent pins. To elaborate and with reference to FIG. 8, if a pin extends substantially from the top side 224A to the bottom side 224B of a quadrilateral boundary, the pin presents a high reactive impedance with low ohmic loss. The second terminal ends of immediately adjacent pins can contact a conductive surface without impacting the impedance. With reference to FIG. 8, each of the pins in the array of pins 210 is of sufficient length to present a high reactive impedance with low ohmic loss relative to the radiative structure 202. Further, because the pins are of sufficient length, the contact between the second terminal end of each of the pins and the conductive surface 206 has little, if any, impact on the high reactive impedance. If the pin extends beyond the bottom side 224B of the quadrilateral boundary, the additional length has little, if any, impact on the high reactive impedance of the pin. Consequently, if two immediately adjacent pins each have such an additional length, a conductive material can extend between the additional lengths or contact the second terminal ends of the pins with little, if any, effect on the high reactive impedance with low ohmic loss presented by each of the pins. As such, it should be appreciated that if needed or desired pins in the array of pins 210 can contact, be connected to, or be an integral part of the conductive surface 206.

Figure 16:
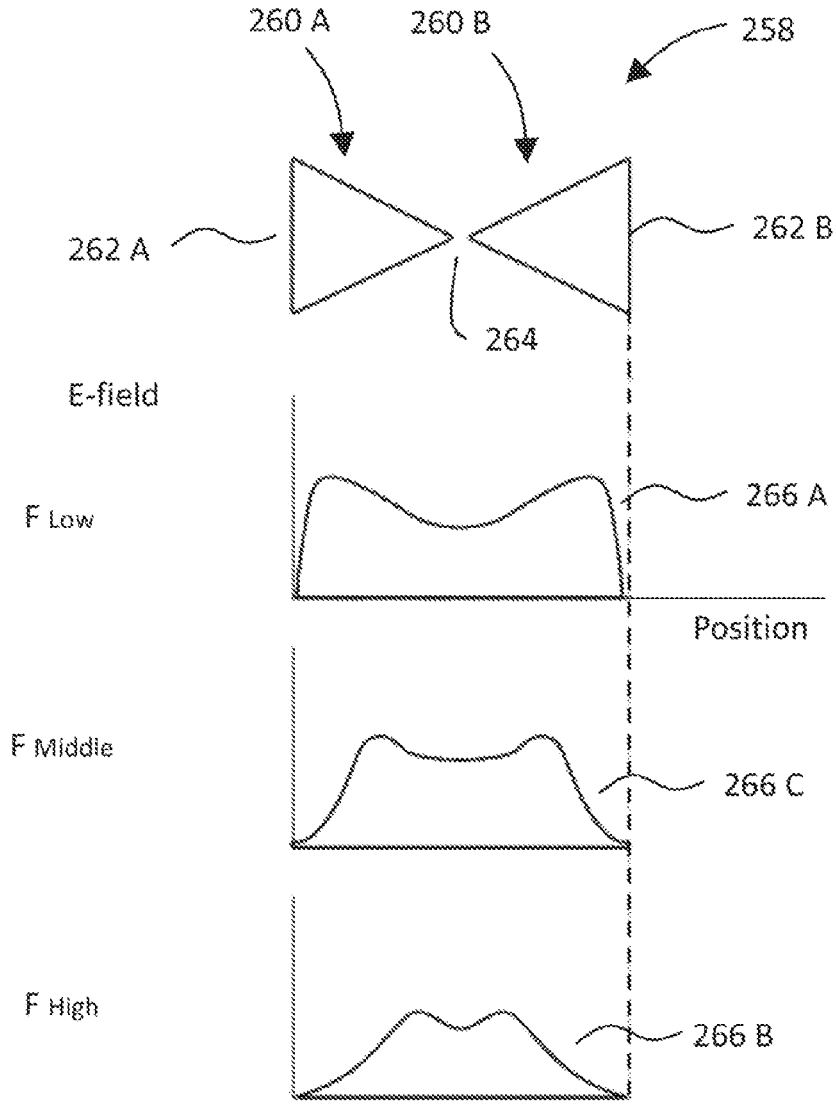
FIG. 16 illustrates the frequency of an E-field profile for a bowtie antenna.

A pin relative to a point on the surface 208 of the radiative structure 202 that is within a boundary provides substantial non-resonance, substantial insusceptibility to currents induced by the E-field of the antenna, a high reactive impedance with low ohmic loss, and the ability to accommodate a predetermined power. However, certain geometric characteristics associated with the pins in the array of pins 210 and that relate to the bandwidth over which the free-space antenna operates provide a basis for improving the operation of the antenna system with respect to one or more of the substantial non-resonance, substantial insusceptibility to induced currents, high reactive impedance with low ohmic loss, and accommodate a desired power. By way of example and with reference to FIG. 16, these geometric characteristic are discussed with respect to a bowtie antenna 258 having a radiative structure comprised of a first radiative element 260A and a second radiative element 260B. The radiative structure extends from a first end 262A to a second end 262B. Located between the first and second ends 262A, 262B is a mid-point 264. Also shown is a first plot 266A of the intensity of the E-field $f_{low}$ (i.e., the frequency that defines the low end of the bandwidth of the antenna) relative to the lateral extent of the bowtie antenna 258. As the first plot 266A illustrates, the E-field at $f_{low}$ has two peaks, one near the first end 262A of the radiative structure and the other near the second end 262B of the structure. A second plot 266B illustrates the intensity of the E-field at $f_{high}$ (i.e., the frequency that defines the high end of the bandwidth of the antenna) relative to the lateral extent of the bowtie antenna. As the second plot 266B illustrates, the intensity of the E-field at $f_{high}$ has two peaks near the midpoint 264. A third plot 266C illustrates the intensity of the E-field at $f_{middle}$ (i.e., the frequency midway between $f_{high}$ and $f_{low}$) relative to the lateral extent of the bowtie antenna. The third plot 262C illustrates that the intensity of the E-field at $f_{middle}$ has two peaks, one peak located approximately midway between the first end 262A and the mid-point 264 and the other peak located approximately midway between the second end 262B and the mid-point 264. As the plots illustrate, the frequency profile of the E-field produced by the bowtie antenna 258 shows that higher frequencies are more closely associated with the portions of the radiative structure near the mid-point 264 and the lower frequencies are more closely associated with portions of the antenna near the ends 262A, 262B. It should be appreciated that other free-space broadband antennas have E-field intensities for frequencies within the bandwidth of the antenna with peaks that correlate to the particular geometric features of the antenna.

Figure 17A:
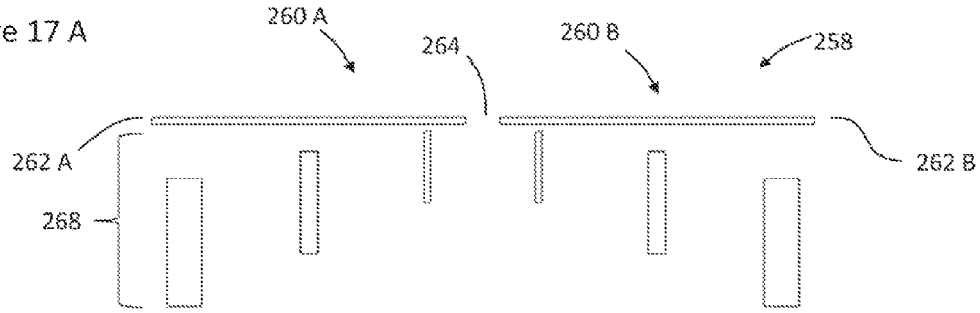
FIGS. 17A and 17B are side and plan views of a bowtie antenna with a high-impedance backing comprised of an array of pins where the pins are scaled in length, cross-section, distance from the surface of the radiative structure, and distance from one another in accordance with the frequency of an E-field profile of the antenna.
Figure 17B:
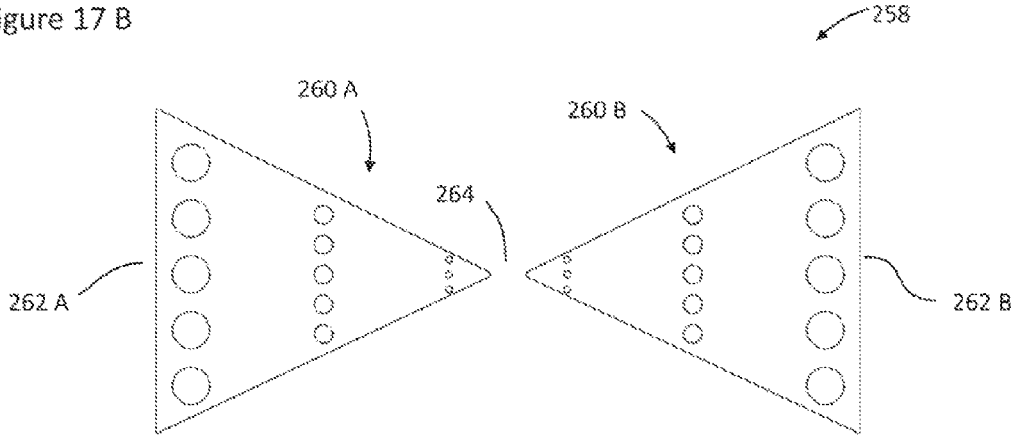

With reference to FIGS. 17A and 17B, four geometric features related to pins in an array of pins 268 are scaled based on the frequency profile of the E-field of the antenna 258. The four geometric features are the lateral cross-sectional area of the pins, the length of the pins, the spacing between pins, and the distance of the pins from the radiative structure comprised of the first and second radiative elements 260A, 260B. For purposes of illustration, all the pins are assumed to have a cylindrical shape. Pins with other shapes can be utilized. For instance, all the pins could have square, rectangular, or triangular cross-sections. Pins with more complex geometries, such as bristles with sub-pins, rod-patch pins etc., can be employed. Moreover, while the general shape of each of the pins is likely to be the same or substantially the same for all of the pins in the array, variations in the shapes of the pins in the array are feasible. For instance, a number of pins in the array can have a cylindrical shape with a circular lateral cross-section and a number of other pins in the array can have a cylinder-like shape with a triangular lateral cross-section. In any event, one or more of the noted geometric characteristics can be scaled in accordance with the frequency profile of the E-field associated with the antenna 258. As shown in FIGS. 17A and 17B, the lateral cross-sectional area of the pins in the array of pins increases with decreasing frequency in the E-field profile; the length of pins in the array of pins increases with decreasing frequency in the E-field profile, the spacing between pins in the array of pins increases with decreasing frequency in the E-field profile, and the distance between the first terminal ends of pins in the array of pins and the surface of the radiative structure increases with decreasing frequency in the E-field profile.

Figure 18:
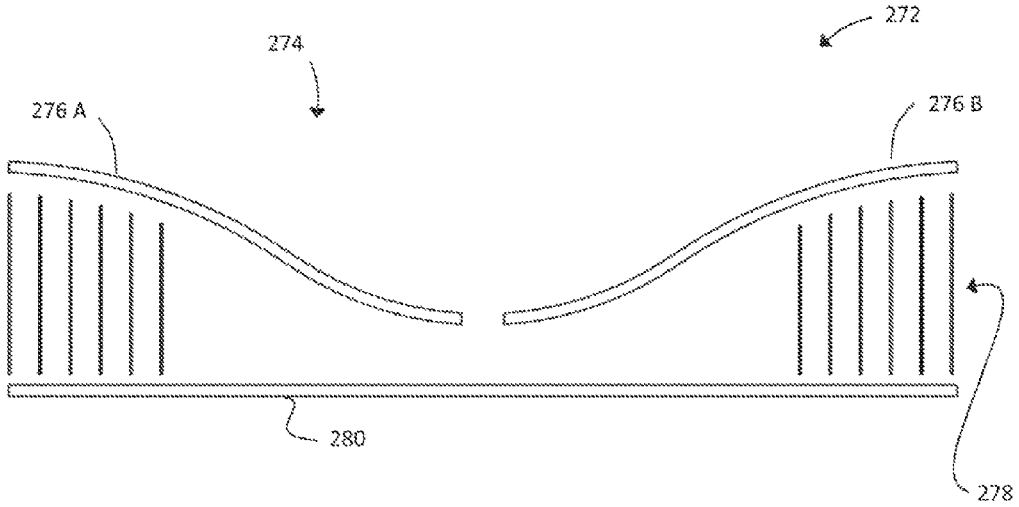
FIG. 18 is a side view of a bowtie antenna in which a high impedance backing is only disposed under a portion of the radiative structure.

In certain instances, an antenna system comprised of a broadband, free-space antenna and a high impedance backing in which the high impedance backing is associated with less than the entire portion of the radiative structure of the antenna that is to be positioned adjacent to a conductive surface is feasible. By way of example, FIG. 18 illustrates an antenna system 272 comprised of: (a) a bowtie antenna 274 with a radiative structure comprised of first and second radiative elements 276A, 276B and (b) a high-impedance backing 278 that includes an array of pins. Both of the radiative elements 276A, 276B are positioned adjacent to a conductive surface 280. The high impedance backing 278 is associated with the low or lower frequency dominant portion of the antenna (FIG. 16), i.e. the portion of the antenna that, in the absence of the backing, would have the greatest λ/4 spacing requirement. As such, the high impedance backing 278 reduces the spacing between the low or lower frequency dominant portion of the antenna and the conductive surface 280. The higher frequency portion of the antenna is substantially provided with λ/4 spacing by curving or bending the first and second radiative elements 276A, 276B toward the conductive surface and thereby avoiding the need for a high-impedance backing in this area. It should be appreciated that this spacing can be achieved in many other ways. For instance, if the radiative elements were planar, the conductive surface could be curved. As yet another alternative for achieving λ/4 spacing and avoiding the use of the high impedance backing is to curve both the radiative elements and the conductive surface.

It should be appreciated that, while the antenna system has largely been described with respect to a bowtie antenna, the antenna system can employ other broadband free-space antennas. Further, it should also be appreciated that not every pin in the array of pins needs to perform as described. For instance, if due to manufacturing defects or damage due to use, several pins in a relatively large array of pins are bent such that each extends outside the relevant boundary or several pins in the array are broken, the array is still likely to make a sufficient contribution to the function of the high impedance backing The foregoing description of the invention is intended to explain the best mode known of practicing the invention and to enable others skilled in the art to utilize the invention in various embodiments and with the various modifications required by their particular applications or uses of the invention.

What is claimed is:

1. A broadband antenna system comprising:

a broadband free-space antenna that is capable of radiation or reception of an electromagnetic wave over a bandwidth that extends from a low-frequency ($f_{low}$) to a high-frequency ($f_{high}$) and does not employ a ground plane to establish a resonant radiator structure;

wherein the broadband free-space antenna has a radiative structure with a surface; and a high-impedance backing positioned adjacent to the surface of the radiative structure of the free-space antenna to allow the surface to be positioned: (a) adjacent to a conductive surface that would otherwise have a substantial adverse effect on the bandwidth of the free-space antenna and (b) within $\lambda_{low}/4$ of such a conductive surface, where $\lambda_{low}$ is the wavelength of $f_{low}$, the high-impedance backing also capable of accommodating a predetermined amount of power;

wherein the high-impedance backing includes (a) an array of conductive pins, (b) a first dielectric located between the surface of the radiative structure and the array of conductive pins, and (c) a second dielectric located between at least one pair of pins in the conductive array of pins;

wherein each pin in the array of conductive pins extends from a first terminal end to a second terminal end, the first terminal end separated from the surface of the radiative structure by a first distance, and the second terminal end separated from the surface of the radiative structure by a second distance that is greater than the first distance;

wherein the broadband free-space antenna, in operation, produces an electromagnetic wave with an E-field that passes through the high impedance backing, the E-field at any location in the high impedance backing being represented by an E-field vector that specifies an E-field direction and a magnitude that decreases with increasing distance from the surface;

wherein pins in the array of conductive pins each has a shape and position and is made of a material that: (a) presents a high reactive impedance and low ohmic loss to the broadband free-space antenna, (b) is substantially insusceptible to an E-field inducing a current within the pin, (c) is substantially non-resonant, and (d) can accommodate the predetermined amount of power.

2. A broadband antenna system, as claimed in claim 1, wherein:

the broadband free-space antenna is comprised of the radiative structure and no ground plane, wherein the radiative structure has one or more radiative elements.

3. A broadband antenna system, as claimed in claim 1, wherein:

the broadband free-space antenna is one of: a dipole antenna, slot antenna, sinuous antenna, and spiral antenna.

4. A broadband antenna system, as claimed in claim 1, wherein:

the broadband free-space antenna is comprised of the radiative structure and a ground plane, wherein the radiative structure has one or more radiative elements.

5. A broadband antenna system, as claimed in claim 1, wherein:

the broadband free-space antenna is a bent monopole.

6. A broadband antenna system, as claimed in claim 1, wherein:

the radiative structure is one of: (a) planar and (b) non-planar.

7. A broadband antenna system, as claimed in claim 1, wherein:

the first dielectric and the second dielectric are the same material.

8. A broadband antenna system, as claimed in claim 1, wherein:

the first and second dielectrics are each air.

9. A broadband antenna system, as claimed in claim 1, wherein:

the second dielectric supports pins in the array of conductive pins.

10. A broadband antenna system, as claimed in claim 1, wherein:

the pins in the array of conductive pins each has a cross-sectional extent that falls within a pin cross-section boundary located within a plane that is substantially perpendicular to a point on the surface of the radiative structure and that contains the E-field direction vector, the pin cross-section boundary defines the extent of an area that can be occupied by a cross-section of a pin such that: (a) the E-field does not induce a substantial current in the pin, (b) the pin is substantially non-resonant, (c) the pin presents a high reactive impedance and low ohmic loss to the radiative structure, and (d) the pin is capable of accommodating a predetermined amount of power.

11. A broadband antenna system, as claimed in claim 10, wherein:

the pin cross-section boundary has lateral boundaries that diverge from one another as the distance from the radiative structure increases.

12. A broadband antenna system, as claimed in claim 10, wherein:

the pin cross-section boundary has a trapezoidal shape.

13. A broadband antenna system, as claimed in claim 1, wherein:

the pins in the array of conductive pins each has an extent that falls within a three-dimensional pin boundary, the three-dimensional pin boundary defines the extent of the volume that can be occupied by a pin such that: (a) the E-field does not induce a substantial current in the pin, (b) the pin is substantially non-resonant, (c) the pin presents a high reactive impedance and low ohmic loss to the radiative structure, and (d) the pin is capable of accommodating a predetermined amount of power.

14. A broadband antenna system, as claimed in claim 13, wherein:

the three-dimensional pin boundary has a pin cross-section boundary located within a plane that is substantially perpendicular to a point on the surface of the broadband free-space antenna and that contains the E-field vector, the pin cross-section boundary having lateral boundaries that diverge from one another as the distance from the radiative structure increases.

15. A broadband antenna system, as claimed in claim 14, wherein:

the three-dimensional pin boundary is defined by the pin cross-section boundary linearly translated in a direction perpendicular to the E-field vector and within the high impedance backing.

16. A broadband antenna system, as claimed in claim 14, wherein:

the three dimensional pin boundary is defined by translating the pin cross-section boundary between points associated with the surface where the E-field magnitude decreases with increasing distance from the surface of the radiative structure in substantially the same fashion.

17. A broadband antenna system, as claimed in claim 13, wherein:

the three-dimensional pin boundary is a mesa with a cross-section that has lateral sides that diverge from one another as the distance from the radiative structure increases.

18. A broadband antenna system, as claimed in claim 1, wherein:

at least one pin in the array of conductive pins is a bristle.

19. A broadband antenna system, as claimed in claim 1, wherein:

at least one pin in the array of conductive pins is comprised of a plurality of sub-pins.

20. A broadband antenna system, as claimed in claim 1, further comprising:

a third dielectric that is located between the second terminal ends of pins in the array of conductive pins and a surface that is farther from the surface of the radiative structure than the second terminal ends.

21. A broadband antenna system, as claimed in claim 1, further comprising:

a conductive surface that is positioned such that the high-impedance backing is located between the conductive surface and the surface of the radiative structure.

22. A broadband antenna system, as claimed in claim 21, wherein:

the conductive surface supports pins in the array of conductive pins.

23. A broadband antenna system comprising:

a broadband free-space antenna that is capable of radiation or reception of an electromagnetic wave over a bandwidth that extends from a low-frequency ($f_{low}$) to a high-frequency ($f_{high}$) and does not employ a ground plane to establish a resonant radiator structure;

wherein the broadband free-space antenna has a radiative structure with a surface; and wherein, in operation, the broadband free-space antenna has a an electric field profile over the frequencies in the bandwidth in which each frequency across the bandwidth of the broadband free-space antenna is more strongly associated with a particular portion of the radiative structure than other frequencies across the bandwidth;

a high-impedance backing capable of accommodating a predetermined amount of power;

the high-impedance backing positioned adjacent to the surface of the radiative structure of the broadband free-space antenna to allow the free-space antenna to be positioned: (a) adjacent to a conductive surface that would otherwise adversely affect the bandwidth of the free-space antenna and (b) within $\lambda_{low}/4$ of such a conductive surface, where $\lambda_{low}$ is the wavelength of $f_{low}$;

wherein the high-impedance backing comprises an array of conductive pins and a dielectric structure located between the surface of the radiative structure and the array of conductive pins and between the pins in the array of conductive pins;

wherein the broadband free-space antenna, in operation, has an electromagnetic wave with an E-field that passes through the high impedance backing, the E-field at any location in the high impedance backing being represented by and E-field vector that specifies an E-field direction and a magnitude that decreases with increasing distance from the surface;

wherein each pin in the array of conductive pins extends from a first terminal end to a second terminal end, the first terminal end separated from the surface of the broadband free-space antenna by a first distance, and the second terminal end separated from the surface of the broadband free-space antenna by a second distance that is greater than the first distance;

wherein pins in the array of conductive pins are each substantially inductive, substantially non-resonant, have insubstantial current flow in the presence of the E-field, can accommodate the predetermined amount of power;

wherein the array of conductive pins has a scaled geometric characteristic related to the electric field profile over the frequencies in the bandwidth.

24. A broadband antenna system, as claimed in claim 23, wherein:

the scaled geometric characteristic is that the lateral cross-sectional area of pins in the array of conductive pins increases with decreasing frequency in the electric field profile.

25. A broadband antenna system, as claimed in claim 23, wherein:

the scaled geometric characteristic is that the length of pins in the array of conductive pins increases with decreasing frequency in the electric field profile.

26. A broadband antenna system, as claimed in claim 23, wherein:

the scaled geometric characteristic is that the spacing between pins in the array of conductive pins increases with decreasing frequency in the electric field profile.

27. A broadband antenna system, as claimed in claim 23, wherein:

the scaled geometric characteristic is that the first distance between the first terminal end of a pin and the surface of the radiative structure increases with decreasing frequency in the electric field profile.

28. A broadband antenna system, as claimed in claim 23, wherein:

the second terminal end of each of the pins operatively contacts a conductive surface.

29. A broadband antenna system, as claimed in claim 23, wherein:

at least one of the pins in the array of conductive pins includes a metal.

30. A broadband antenna system, as claimed in claim 29, wherein:

the metal is a non-magnetic metal.

31. A broadband antenna system, as claimed in claim 30, wherein:

the non-magnetic metal includes one of: copper and aluminum.

32. A broadband antenna system, as claimed in claim 23, wherein:

at least one of the pins in the array of conductive pins includes a magnetic metal.

33. A broadband antenna system, as claimed in claim 32, wherein:

the magnetic metal includes one of: iron, steel, nickel, cobalt, and alloys thereof.

34. A broadband antenna system, as claimed in claim 23, wherein:

at least one of the pins in the array of conductive pins includes a non-metallic material.

35. A broadband antenna system, as claimed in claim 34, wherein:

the non-metallic material is one of: carbon fiber and a conductive organic material.

36. A broadband antenna system, as claimed in claim 23, wherein:

each pin in the array of pins has a normal distance between the first and second terminal ends that is less than $\lambda_{low}/4$.

* * * * *